US007109456B2

(12) United States Patent
Jeong

(10) Patent No.: US 7,109,456 B2
(45) Date of Patent: Sep. 19, 2006

(54) MICROWAVE OVEN AND ROTATING AND RECIPROCATING TURNTABLE THEREOF

(75) Inventor: Sang Jin Jeong, Yongin-Si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 11/116,210

(22) Filed: Apr. 28, 2005

(65) Prior Publication Data

US 2005/0274720 A1 Dec. 15, 2005

(30) Foreign Application Priority Data

Jun. 15, 2004 (KR) ..... 10-2004-0044168

(51) Int. Cl.
*H05B 6/78* (2006.01)
*F24C 15/16* (2006.01)

(52) U.S. Cl. ..... 219/754; 219/753; 219/762; 126/388

(58) Field of Classification Search ..... 219/752–755, 219/762–763; 126/388; 108/139–141, 20
See application file for complete search history.

(56) References Cited

U.S. PATENT DOCUMENTS 4,757,173 A * 7/1988 Park ..... 219/753
5,315,086 A 5/1994 Pressouyre
5,804,800 A * 9/1998 Lee et al. ..... 219/753
6,512,213 B1 * 1/2003 Choi ..... 219/754

FOREIGN PATENT DOCUMENTS

| | | | |
|---|---|---|---|
| JP | 52-113444 | | 9/1977 |
| JP | 55-10433 | A | 1/1980 |
| JP | 9-53830 | A | 2/1997 |
| JP | 2001-319770 | * | 11/2001 |
| KR | 91-1043 | U | 1/1991 |
| KR | 91-2948 | U | 2/1991 |
| KR | 20-0248867 | Y1 | 11/2001 |
| KR | 20-0248986 | Y1 | 11/2001 |

* cited by examiner

*Primary Examiner*—Philip H. Leung
(74) *Attorney, Agent, or Firm*—Sughrue Mion, PLLC

(57) ABSTRACT

A microwave oven for enabling smooth rotation and linear reciprocation of a turntable is provided with a turntable installed therein to rotate and linearly reciprocate within a cooking compartment. The microwave oven includes a reciprocation guidance member, for supporting the turntable, provided between the turntable and the bottom of the cooking compartment. The reciprocation guidance member is moveable with the turntable in a linearly reciprocating direction. Through the use of such a reciprocation guidance member, it is possible to prevent interference between the rotation and the linear reciprocation of the turntable, resulting in smooth rotation and reciprocation of the turntable.

10 Claims, 4 Drawing Sheets

MICROWAVE OVEN AND ROTATING AND RECIPROCATING TURNTABLE THEREOF

CROSS-REFERENCE TO RELATED APPLICATION

This application claims the benefit of Korean Patent Application No. 2004-44168, filed Jun. 15, 2004 in the Korean Intellectual Property Office, the disclosure of which is incorporated herein by reference.

BACKGROUND OF THE INVENTION

1. Field of the Invention

The present invention relates to a microwave oven and, more particularly, to a microwave oven in which a turntable, for bearing food thereon, is installed on the bottom of a cooking compartment in a rotatable and reciprocally movable manner, thereby enabling uniform cooking of the food.

2. Description of the Related Art

In general, a microwave oven is an appliance in which food is cooked by frictional heat of water molecules, produced as high-frequency waves generated from a magnetron, are irradiated to the interior of a cooking compartment to repeatedly convert the molecular arrangement of water contained in the food.

Such a microwave oven comprises a body forming an outer appearance of the microwave oven, and a rectangular box-shaped inner case for dividing the interior of the body into a cooking compartment inside the inner case, and an electric element compartment outside the inner case.

On the bottom of the cooking compartment is installed a turntable so that the turntable is rotatable in a state wherein food is disposed thereon. Rotation of the turntable is achieved by a motor mounted at the outer lower surface of the inner case. Inside the electric element compartment are mounted a magnetron for generating high-frequency waves and irradiating the waves to the interior of the cooking compartment, a high-pressure condenser, and a high-pressure transformer for applying a high voltage to the magnetron, etc.

When the microwave oven configured as stated above is operated, the high-frequency waves generated from the magnetron are irradiated to the interior of the cooking compartment, thus allowing the food, rotating along with the turntable, to be cooked as the high-frequency waves are irradiated thereto.

Such a conventional microwave oven, however, has a limitation to uniformly cook the food since the turntable is rotated in a prescribed fixed position on the bottom of the cooking compartment.

In order to overcome the above problem, Korean Registration Patent No. 10-0423993 discloses a microwave oven comprising a turntable, which is rotatable and reciprocally movable, for enabling uniform cooking of food disposed on the turntable.

The disclosed microwave oven further comprises an elongated slot formed at the bottom of the cooking compartment, a shaft coupled at an upper end thereof to a lower surface of the turntable, a lower end of the shaft extending downwardly through the elongated slot below the cooking compartment, a pinion formed at an outer circumference of the shaft at the outside of the cooking compartment, a guide member formed with a rack to be engaged with the pinion, the guide member being fixedly positioned below the cooking compartment, a first link, having a first end hingedly connected to the lower end of the shaft, and a second moveable end, and a second link, having a first end hingedly connected to the second movable end of the first link, and a second end fixed to a rotating shaft of a motor mounted below the cooking compartment.

With such a configuration, if the second link is rotated in one direction along with the rotating shaft of the motor, the first link is pulled toward or pushed away from the motor as the pinion is rotated forward or reverse along the rack according to a rotation range of the second link, thereby causing the shaft to rotate and linearly reciprocate along the elongated slot. This makes it possible for the turntable to rotate as well as linearly reciprocate on the bottom of the cooking compartment along with the shaft, thus enabling uniform cooking of the food on the turntable.

In the above described conventional microwave oven, between the bottom of the cooking compartment and the turntable is installed a sliding member. The sliding member serves to reduce a frictional resistance between the turntable and the bottom of the cooking compartment, thereby securing smooth rotation and linear reciprocation of the turntable. For this, the sliding member is made of a material having a low frictional coefficient.

A problem of the conventional microwave oven is that the turntable is rotated and linearly reciprocated in a surface-to-surface contact state with the sliding member, resulting in interference between rotation and linear reciprocation of the turntable, and limiting smooth operation of the turntable. In a surface-to-surface contact state between the turntable and the bottom of the cooking compartment, furthermore, if a relatively large load is applied to the bottom of the cooking compartment due to heavy foodstuff disposed on the turntable, a frictional force between the turntable and the bottom of the cooking compartment is increased largely, thereby hindering smooth rotation and linear reciprocation of the turntable.

SUMMARY OF THE INVENTION

The present invention has been made in view of the above-mentioned problems, and an aspect of the invention is to provide a microwave oven for enabling smooth rotation and linear reciprocation of a turntable.

In accordance with one exemplary aspect, this aspect is accomplished by the provision of a microwave oven comprising: a cooking compartment; a turntable installed inside the cooking compartment in a rotatable and reciprocally movable manner; and a reciprocation guidance member, which supports the turntable, provided between the turntable and the bottom of the cooking compartment, wherein the reciprocation guidance member is movable with the turntable in a linear reciprocating direction.

In accordance with another exemplary aspect, this is accomplished by a microwave oven comprising: a driving device for rotating and linearly reciprocating a turntable installed inside a cooking compartment, and a reciprocating guidance member. The driving device includes an elongated slot formed at the bottom of the cooking compartment; a shaft, having a first end coupled to the turntable, and a second end extending through the elongated slot; and a driver unit, which rotates and linearly reciprocates the shaft within and along the elongated slot, positioned outside of the cooking compartment. The reciprocation guidance member supports the turntable, is provided between the turntable and the bottom of the cooking compartment, includes a through-hole for the penetration of the shaft, and is movable with the turntable in a linear reciprocating direction.

Wheels may be provided between the reciprocation guidance member and the bottom of the cooking compartment.

The wheels may be attached to the reciprocation guidance member, and at least one linear rail, which guides the movement of the wheels, may be provided at the bottom of the cooking compartment.

The microwave oven may further comprises a rotation guidance member provided between the turntable and the reciprocation guidance member, The rotation guidance member is movable with the turntable in a rotating direction, and includes secondary wheels provided between the turntable and the reciprocation guidance member.

The reciprocation guidance member may include a circular rail for guiding the movement of the secondary wheels.

The rotation guidance member may further include a rotating ring configured so that the shaft is positioned therein, wherein the secondary wheels are coupled to a circumference of the rotating ring.

A plurality of the wheels attached to the reciprocation guidance member may be provided at each side of the elongated slot.

A plurality of the linear rails may extend parallel to a longitudinal direction of the elongated slot.

At least one linear rail may be provided at each side of the elongated slot, and a plurality of the wheels attached to the reciprocation guidance member may be provided to correspond to each of the rails.

BRIEF DESCRIPTION OF THE DRAWINGS

These and/or other aspects and advantages of the invention will become apparent and more readily appreciated from the following description of the exemplary embodiments, taken in conjunction with the accompanying drawings of which.

DETAILED DESCRIPTION OF THE ILLUSTRATIVE, NON-LIMITING EMBODIMENTS

Figure 1:
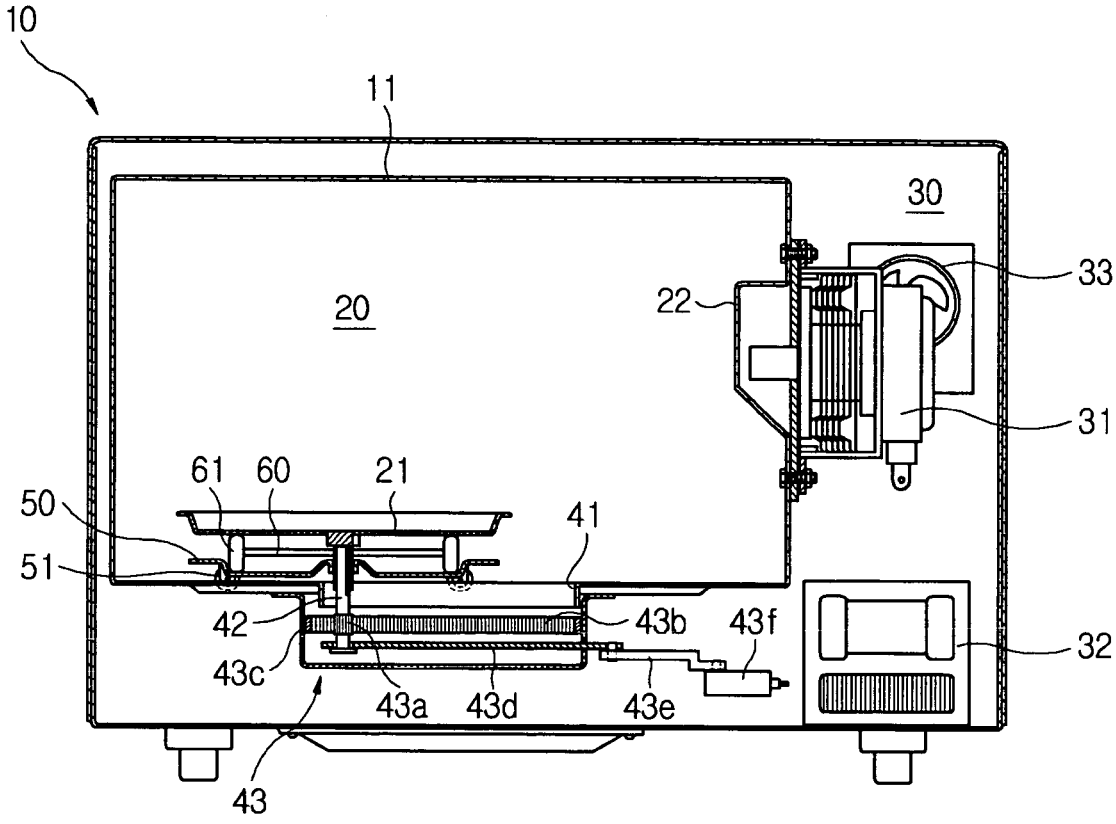
FIG. 1 is a sectional view illustrating an exemplary microwave oven in accordance with the present invention.

Reference will now be made in detail to an exemplary embodiment of the present invention. The exemplary embodiment is described below to explain the present invention by referring to the drawings.

Referring to FIG. 1 illustrating a microwave oven in accordance with an example of the present invention, the microwave oven comprises a body 10 forming an outer appearance of the microwave oven, and an inner case 11 provided inside the body 10 for dividing the interior of the body 10 into a cooking compartment 20 inside the inner case 11, and an electric element compartment 30 outside the inner case 11. The inner case 11 has a rectangular box-shape opened at a front side thereof. To a front side of the body 10 is hingedly coupled a door (not shown) for the opening or closing of the cooking compartment 20. Further, there is provided an operating panel (not shown) including a plurality of operating buttons for controlling various functions of the microwave oven.

Inside the electric element compartment 30, which is defined at the right side of the cooking compartment 20 viewed in FIG. 1, are mounted a magnetron 31 for generating high-frequency waves to be irradiated to the interior of the cooking compartment 20, a high-pressure transformer 32 and high-pressure condenser (not shown) for applying a high voltage to the magnetron 31, and a cooling fan 33 for cooling respective elements inside the electric element compartment 30. Inside the cooking compartment 20 are installed a turntable 21 on the bottom of the cooking compartment 20 for bearing food thereon, and a wave guide 22 for guiding the high-frequency waves irradiated from the magnetron 31 to the interior of the cooking compartment 20.

With such a configuration, if the microwave oven is operated to irradiate the high-frequency waves to the interior of the cooking compartment 20 after the food is disposed on the turntable 21, the food inside the cooking compartment 20 is cooked by a frictional heat of water molecules produced as the high-frequency waves are irradiated to the food so as to repeatedly convert the molecular arrangement of water contained in the food.

An exemplary microwave oven according to the present invention further comprises a driving device for rotating and linearly reciprocating the turntable 21, thereby allowing the high-frequency waves to be more uniformly irradiated to the food on the turntable 21. Such a driving device includes an elongated slot 41 centrally formed at the bottom of the cooking compartment 20 so that it is equally spaced apart from left and right walls of the inner case 11, a shaft 42 coupled at an upper end thereof to a lower surface of the turntable 21, a lower end of the shaft 42 extending downwardly through the elongated slot 41 below the cooking compartment 20, and a driver unit 43 positioned below the cooking compartment 20 for rotating and linearly moving the shaft 42 along the elongated slot 41.

The driver unit 43 includes a pinion 43*a* formed at an outer circumference of the shaft 42 below the cooking compartment 20, a guide member 43*c* formed with a rack 43*b* to be engaged with the pinion 43*a*, the guide member 43*c* being fixedly positioned below the cooking compartment 20, a first link 43*d*, having a first end hingedly connected to the lower end of the shaft 42, and having a second, moveable, end, and a second link 43*e*, having a first end hingedly connected to the second, movable, end of the first link 43*d*, and having a second end fixed to a rotating shaft of a motor 43*f* mounted below the cooking compartment 20.

If the second link 43*e* is rotated in one direction along with the rotating shaft of the motor 43*f*, the first link 43*d* is pulled toward or pushed away from the motor 43*f* as the pinion 43*a* is rotated forward or reverse along the rack 43*b* according to a rotation range of the second link 43*e*, thereby causing the shaft 42 to rotate and linearly reciprocate along the elongated slot 41. This makes it possible for the turntable 21 to rotate and linearly reciprocate on the bottom of the cooking compartment 20, along with the shaft 42, thus enabling uniform cooking of the food on the turntable 21.

For reference, such a driving device of the present invention is adaptable into various different shapes so long as it can rotate and linearly reciprocate the turntable 21.

Figure 2:
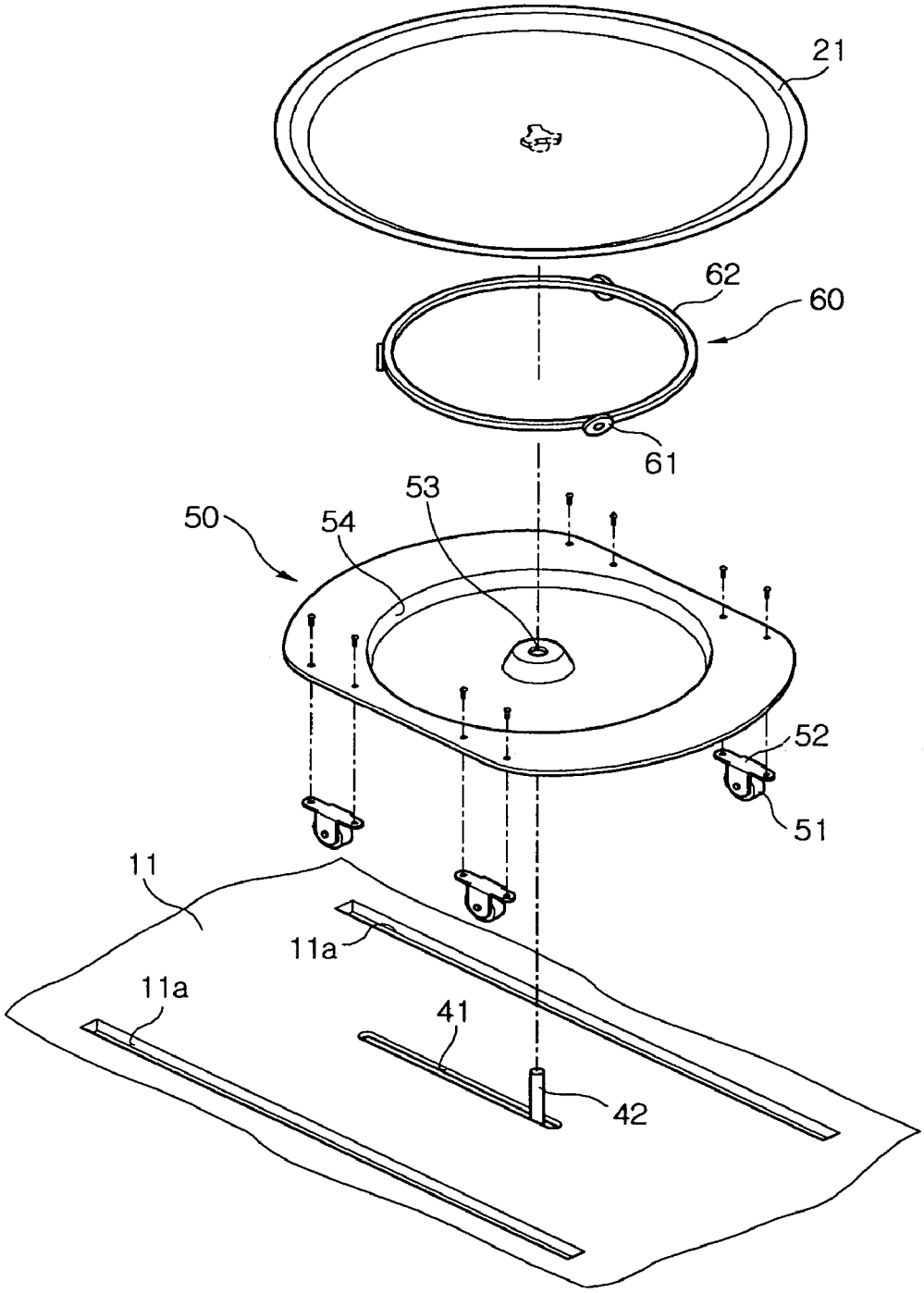
FIG. 2 is an exploded perspective view illustrating a reciprocation guidance member, a rotation guidance member, and a turntable to be installed on the bottom of a cooking compartment of an exemplary microwave oven in accordance with the present invention.

Referring now to FIG. 2, between the bottom of the cooking compartment 20 and the turntable 21 is interposed a reciprocation guidance member 50 for securing smooth linear reciprocation of the turntable 21. The reciprocation guidance member 50 serves to support the turntable 21, and is movable while rolling in a linearly reciprocating direction of the turntable 21. For enabling such a rolling movement of the reciprocation guidance member 50, linearly movable wheels 51 are installed between the reciprocation guidance member 50 and the bottom of the cooking compartment 20.

As shown in FIG. 2, the reciprocation guidance member 50, having a plate shape, is centrally formed with a through-hole 53 for allowing the shaft 42 of the driving device to be fitted so as to penetrate therethrough. When the shaft 42 is fitted in the through-hole 53, as the shaft 42 linearly reciprocates, the reciprocation guidance member 50 is reciprocally movable along with the shaft 42.

The linearly movable wheels 51 are installed to the reciprocation guidance member 50 by means of mounts 52. The mounts 52 are screwed to a lower surface of the reciprocation guidance member 50 for rotatably supporting the wheels 51, respectively. The reciprocation guidance member 50, configured as stated above, is reciprocally movable, along with the turntable 21, in a state wherein it is supported by the wheels 51 rolling in a line or point contact state with the bottom of the cooking compartment 20. Such a reciprocation guidance member 50 is capable of supporting the turntable 21. For reference, the mounts 52 may be welded to the reciprocation guidance member 50 differently from FIG. 2.

As the reciprocation guidance member 50 linearly reciprocates with the turntable 21 and supports the turntable 21, there is no interference between rotation and linear reciprocation of the turntable 21, resulting in smooth rotation and linear reciprocation thereof.

Further, as the reciprocation guidance member 50 linearly reciprocates in a line or point contact with the bottom of the cooking compartment 20, by means of the wheels 51, and supports the turntable 21, the turntable 21 can exhibit a largely reduced frictional force when it linearly reciprocates on the bottom of the cooking compartment 20.

For guiding rolling movement of the linearly movable wheels 51, at the bottom of the cooking compartment 20 are formed linear rails 11*a*. The linear rails 11*a* are frontwardly and rearwardly spaced apart from the elongated slot 41 by equal distances so that they extend parallel to a longitudinal direction of the elongated slot 41. The linear rails 11*a* take the form of linear grooves defined in the bottom of the cooking compartment 20 at the front and rear sides of the elongated slot 41 so that lower portions of the linearly movable wheels 51 are received in the rails 11*a*. These rails 11*a* serve to guide movement of the linearly movable wheels 51, and prevent separation thereof.

A plurality of the linearly movable wheels 51 can be provided so that plural wheels 51 are allotted in each of the rails 11*a*. This is effective to balance the reciprocation guidance member 50 so as not to be inclined. The number of the rails 11*a* can be freely selected so long as the rails 11*a* are provided in parallel to the longitudinal direction of the elongated slot 41.

Between the turntable 21 and the reciprocation guidance member 50 is interposed a rotation guidance member 60 for securing smooth rotation of the turntable 21. Such a rotation guidance member 60 serves to support the turntable 21, and is movable while rolling in a rotating direction of the turntable 21. The rotation guidance member 60 includes a rotating ring 62, and circularly movable wheels 61 coupled at an outer circumference of the rotating ring 62 so that they are rotatably supported between the turntable 21 and the reciprocation guidance member 50. In the center of the rotating ring 62 is positioned the shaft 42. A plurality of the circularly movable wheels 61 are provided so that they are equally spaced apart from each other along the outer circumference of the rotating ring 62.

Considering again the reciprocation guidance member 50, at an upper surface of the reciprocation guidance member 50 is provided a circular rail 54. The circular rail 54 serves to prevent separation of the rotation guidance member 60 and to guide movement of the linearly movable wheels 61, thereby securing stable motion of the rotation guidance member 60. Although the rail 54 takes the form of a disk-shaped recess in the present embodiment, it may take the form of a ring-shaped groove extending along a movement direction of the circularly movable wheels 61 or another form as would be understood by one of ordinary skill in the art.

As stated above in detail, in the microwave oven of the present invention, since the reciprocation guidance member 50 is provided between the turntable 21 and the bottom of the cooking compartment 20 for supporting the turntable 21, and is movable while rolling in a linear reciprocating direction of the turntable 21, the reciprocation guidance member 50 prevents interference between rotation and linear reciprocation of the turntable 21, and secures smooth linear reciprocation of the turntable 21. Further, since the rotation guidance member 60 is provided between the turntable 21 and the reciprocation guidance member 50 so that it is movable while rolling in a rotating direction of the turntable 21 for supporting the turntable 21, the present invention enables smooth rotation of the turntable 21.

Now, the operation and effects of the microwave oven according to the present invention will be explained.

Figure 3:
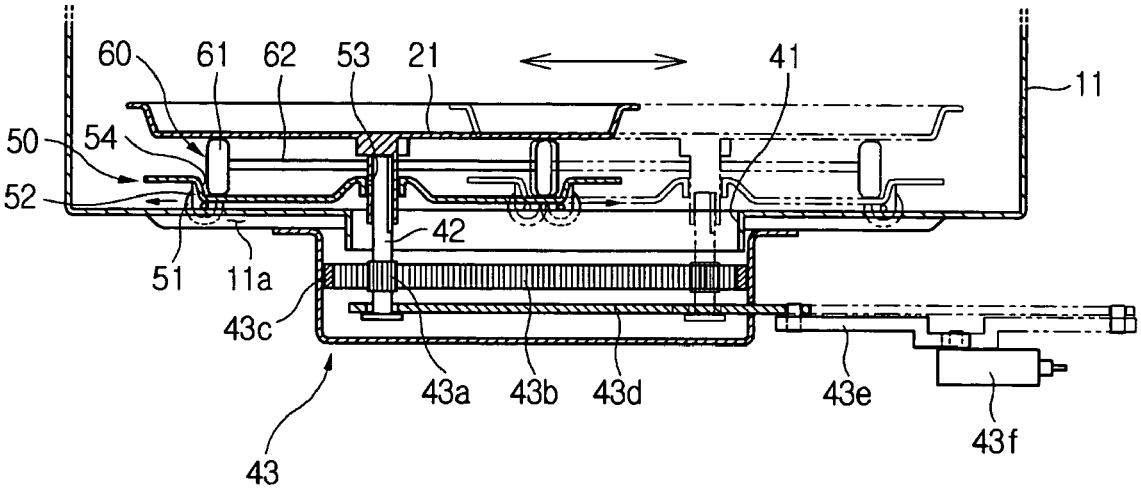
FIG. 3 is a sectional view illustrating the driving of the turntable of an exemplary microwave oven in accordance with the present invention.
Figure 4:
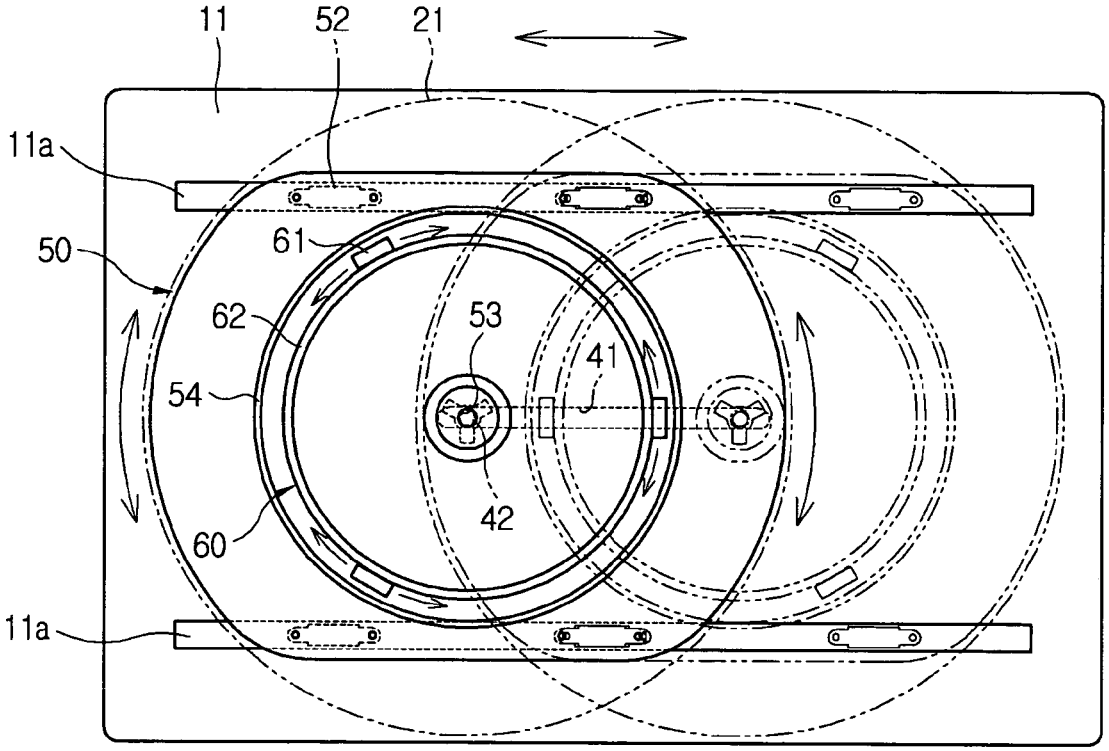
FIG. 4 is a plan view illustrating the driving of the turntable of an exemplary microwave oven in accordance with the present invention.

First, if the second link 43*e* is rotated in one direction along with the rotating shaft of the motor 43*f*, the first link 43*d* is pulled toward or is pushed away from the motor 43*f* as the pinion 43*a* is rotated forward or reverse along the rack 43*b* according to a rotation range of the second link 43*e*, thereby causing the shaft 42 to rotate and linearly reciprocate along the elongated slot 41. This makes it possible for the turntable 21 to rotate and linearly reciprocate on the bottom of the cooking compartment 20 along with the shaft 42, as shown in FIGS. 3 and 4. In this way, the high-frequency waves irradiated from the magnetron 31 to the interior of the cooking compartment 20 are uniformly irradiated onto the food on the turntable 21, thereby enabling uniform cooking of the food.

Since such a rotatable and reciprocally movable turntable 21 is rotated in a supported state by the reciprocation guidance member 50, which is moved in a rolling manner on the bottom of the cooking compartment 20, there is no interference between rotation and reciprocation of the turntable 21, and the turntable 21 can smoothly reciprocate.

Further, since rotation of the turntable 21 is guided by means of the rotation guidance member 60, which is installed between the turntable 21 and the reciprocation guidance member 50 so that it is movable while rolling in a rotating direction of the turntable 21 for supporting the turntable 21, the turntable 21 can smoothly rotate.

As apparent from the above description, a microwave oven consistent with the present invention comprises a reciprocation guidance member provided between a turntable and the bottom of a cooking compartment so that it is movable while rolling in a linear reciprocating direction of the turntable, thereby preventing interference between rotation and reciprocation of the turntable, and securing smooth linear reciprocation of the turntable. Further, a microwave oven in accordance with the present invention comprises a rotation guidance member provided between the turntable and the reciprocation guidance member so that it is movable while rolling in a rotating direction of the turntable, thereby securing smooth rotation of the turntable.

Although a few exemplary embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven comprising:

a cooking compartment;

a turntable, installed inside the cooking compartment in a rotatable and reciprocally moveable manner;

a reciprocation guidance member, which supports the turntable, provided between the turntable and a bottom of the cooking compartment, wherein the reciprocation guidance member is moveable with the turntable in a linear reciprocating direction;

a rotation guidance member provided between the turntable and the reciprocation guidance member, wherein the rotation guidance member is moveable with the turntable in a rotating direction;

wherein the rotation guidance member includes secondary wheels provided between the turntable and the reciprocation guidance member; and wherein the reciprocation guidance member includes a circular rail for guiding the movement of the secondary wheels.

2. A microwave oven comprising:

a driving device for rotating and linearly reciprocating a turntable installed inside a cooking compartment, the driving device comprising:

an elongated slot formed at a bottom of the cooking compartment, a shaft, having a first end coupled to the turntable, and a second end extending through the elongated slot, and a driver unit, which rotates and linearly reciprocates the shaft along the elongated slot, positioned outside the cooking compartment; and a reciprocation guidance member, which supports the turntable, provided between the turntable and the bottom of the cooking compartment, wherein the reciprocation guidance member includes a through-hole for the penetration of the shaft, and is movable with the turntable in a linear reciprocating direction.

3. The microwave oven according to claim 2, wherein wheels are provided between the reciprocation guidance member and the bottom of the cooking compartment.

4. The microwave oven according to claim 3, wherein the wheels are attached to the reciprocation guidance member, and wherein at least one linear rail, which guides the movement of the wheels, is formed at the bottom of the cooking compartment.

5. The microwave oven according to claim 4, wherein a plurality of the linear rails extend parallel to a longitudinal direction of the elongated slot.

6. The microwave oven according to claim 5, wherein at least one linear rail is provided at each side of the elongated slot, and wherein a plurality of the wheels are provided to correspond to each of the rails.

7. The microwave oven according to claim 3, wherein a plurality of the wheels are provided at each side of the elongated slot.

8. The microwave oven according to claim 2, further comprising:

a rotation guidance member provided between the turntable and the reciprocation guidance member, wherein the rotation guidance member is movable with the turntable in a rotating direction and includes secondary wheels provided between the turntable and the reciprocation guidance member.

9. The microwave oven according to claim 8, wherein the reciprocation guidance member includes a circular rail for guiding the movement of the secondary wheels.

10. The microwave oven according to claim 8, wherein the rotation guidance member further includes a rotating ring configured so that the shaft is positioned therein, and wherein the secondary wheels are coupled to a circumference of the rotating ring.

* * * * *